US007309029B2

(12) United States Patent
Boecking

(10) Patent No.: US 7,309,029 B2
(45) Date of Patent: Dec. 18, 2007

(54) FUEL INJECTION DEVICE FOR AN INTERNAL COMBUSTION ENGINE WITH DIRECT FUEL INJECTION, AND METHOD FOR PRODUCING IT THE DEVICE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/579,849

(22) PCT Filed: Sep. 8, 2004

(86) PCT No.: PCT/DE2004/001997

§ 371 (c)(1),
(2), (4) Date: May 17, 2006

(87) PCT Pub. No.: WO2005/052354

PCT Pub. Date: Jun. 9, 2005

(65) Prior Publication Data

US 2007/0108317 A1 May 17, 2007

(30) Foreign Application Priority Data

Nov. 24, 2003 (DE) ..... 103 54 878

(51) Int. Cl.
*F02M 61/00* (2006.01)

(52) U.S. Cl. ..... 239/533.12; 239/533.11; 239/533.4; 239/533.3; 239/533.2; 239/88; 123/304

(58) Field of Classification Search ..... 239/533.11, 239/533.12, 533.4, 533.3, 533.2, 585.1, 88; 123/299, 304
See application file for complete search history.

(56) References Cited

U.S. PATENT DOCUMENTS

| | | | | |
|---|---|---|---|---|
| 4,382,554 | A * | 5/1983 | Hofmann | 239/533.9 |
| 5,743,470 | A * | 4/1998 | Schlaf et al. | 239/533.4 |
| 7,063,272 | B2 * | 6/2006 | Cooke et al. | 239/88 |
| 7,143,964 | B2 * | 12/2006 | Kuegler | 239/533.12 |

FOREIGN PATENT DOCUMENTS

| | | | |
|---|---|---|---|
| DE | 101 22 241 | A1 | 12/2002 |
| DE | 101 55 227 | A1 * | 5/2003 |
| WO | WO 03/040543 | A1 | 5/2003 |

* cited by examiner

*Primary Examiner*—Dinh Q. Nguyen
(74) *Attorney, Agent, or Firm*—Ronald E. Greigg

(57) ABSTRACT

A fuel injection device includes at least two valve elements, disposed in a housing and coaxial with one another, with at least one fuel outlet opening associated with each valve element. On the outer valve element, radially outward from the at least one fuel outlet opening associated with it, there is a first sealing edge which cooperates with a valve seat on the housing and can separate the at least one fuel outlet opening from a high-pressure connection. An additional sealing edge is provided on the outer valve element, between the at least one fuel outlet opening associated with it and the inner valve element.

16 Claims, 4 Drawing Sheets

FUEL INJECTION DEVICE FOR AN INTERNAL COMBUSTION ENGINE WITH DIRECT FUEL INJECTION, AND METHOD FOR PRODUCING IT THE DEVICE

CROSS-REFERENCE TO RELATED APPLICATIONS

This application is a 35 USC 371 application of PCT/DE 2004/001997 filed on Sep. 8, 2004.

BACKGROUND OF THE INVENTION

1. Field of the Invention

The invention relates to a fuel injection device, and to a method of manufacturing the device, for an internal combustion engine with direct fuel injection, the device having a housing and at least two valve elements, located in the housing and coaxial to one another, to each of which at least one fuel outlet opening is assigned, and on the outer valve element, radially outward from the at least one fuel outlet opening assigned to it, there is a first sealing region, which cooperates with a valve seat on the housing and which can separate the at least one fuel outlet opening from a high-pressure connection.

2. Description of the Prior Art

A fuel injection device of the type defined above is known from German Patent Disclosure DE 101 22 241 A1. It has a housing with an outer valve element, in which an inner valve element is guided. Associated with each valve element is a series of fuel outlet openings. Both valve elements are stroke-controlled. This means that they each have a control face which acts in the closing direction and defines a control chamber. In the region of the fuel outlet openings, the valve elements each have pressure faces, which act in the opening direction and define pressure chambers, where at least at some times a high fluid pressure also prevails. The pressure faces and control faces are adapted such that whenever a high pressure prevails in the control chambers, both valve elements are closed. By means of briefly lowering the pressure in the control chamber, the forces operative in the closing direction can be reduced, which leads to an opening of one or both valve elements.

The use of two valve elements, each of which is assigned at least one fuel outlet opening, allows furnishing a small or large total outlet cross section, depending on the quantity of fuel to be injected. This in turn makes it possible to inject even comparatively small fuel quantities at high injection pressure, so that in these cases, good atomization of the fuel is attained. At the same time, high fuel quantities can be injected without requiring very long injection times to do so.

The object of the present invention is to refine a fuel injection device of the type defined at the outset such that it has as long a service life as possible, and the engine driven with it has good emissions performance.

This object is attained in that on the outer valve element, between the at least one fuel outlet opening assigned to it and the inner valve element, there is an additional sealing region.

SUMMARY AND ADVANTAGES OF THE INVENTION

The fuel injection device of the invention has a markedly longer service life than conventional fuel injection devices. The reason for this is that the additional sealing region largely prevents hydrocarbons from the combustion chamber of the internal combustion engine from penetrating the device via the fuel outlet openings associated with the outer valve element and getting into the guide gap between the two valve elements, where it would cause changes in the surface properties and lead to deposits and finally to increased wear.

A further advantage is that the emissions performance of an internal combustion engine that is equipped with fuel injection devices of the invention is very good. The reason for this is the fact that because of the additional sealing region, fuel is prevented from passing through the guide gap between the two valve elements and, with the valve elements otherwise closed, reaching the combustion chamber from the at least one fuel outlet opening associated with the outer valve element.

Advantageous refinements of the invention are disclosed. First, it is proposed that the additional sealing region, immediately after the manufacture of the device, with the outer valve element closed, has a slight spacing, preferably approximately 1 to 2 μm, from a valve seat associated with it. As a result, the production costs of the fuel injection device of the invention are kept low, since producing the sealing region and the valve seat associated with it does not require especially high precision. Instead, the optimal sealing action of the sealing region is achieved only in the course of the initial time in operation of the fuel injection device, namely because of the normal initial deformation or the normal initial wear at the first sealing region and at the valve seat on the housing associated with it.

A chronological pressure profile upon the injection of fuel that is favorable for the emissions performance is attained if the first sealing region is embodied on the edge of a groove extending around the outer valve element.

In a refinement pointing in the same direction, an encompassing shallow groove extends from the encompassing groove approximately into the additional sealing region on the outer valve element.

Alternatively, it is possible that a plurality of grooves are present, distributed over the circumference and all extending in the axial direction approximately from the first groove mentioned approximately into the additional sealing region.

It is also possible that the additional sealing region is embodied on the edge of an encompassing narrow, deep groove, which is located toward the first sealing region. As a result, the so-called "seat throttling" is also varied and optimized.

Preferably, the additional sealing region is embodied on an annular protuberance projecting from the outer valve element. This leads to good sealing action and economical production.

The advantages of the invention are especially striking whenever the fuel injection device is embodied such that a guide gap present between the two valve elements communicates with a chamber that communicates with the high-pressure connection. Such a chamber may for instance be a hydraulic control chamber, of the kind that is present in stroke-controlled valve elements.

To keep production costs low, the outer valve element is fabricated such that the additional sealing region, with the outer valve element closed, initially has a slight spacing, preferably of approximately 1 to 2 μm, from a valve seat associated with it; and that then by repeated actuation of the outer valve element, the first sealing region andlor the valve seat associated with it is deformed such that the spacing between it and the valve seat associated with it becomes less or tends toward zero.

BRIEF DESCRIPTION OF THE DRAWINGS

Especially preferred exemplary embodiments of the present invention will be described in further detail below in conjunction with the accompanying drawings, in which.

DESCRIPTION OF THE PREFERRED EMBODIMENTS

Figure 1:
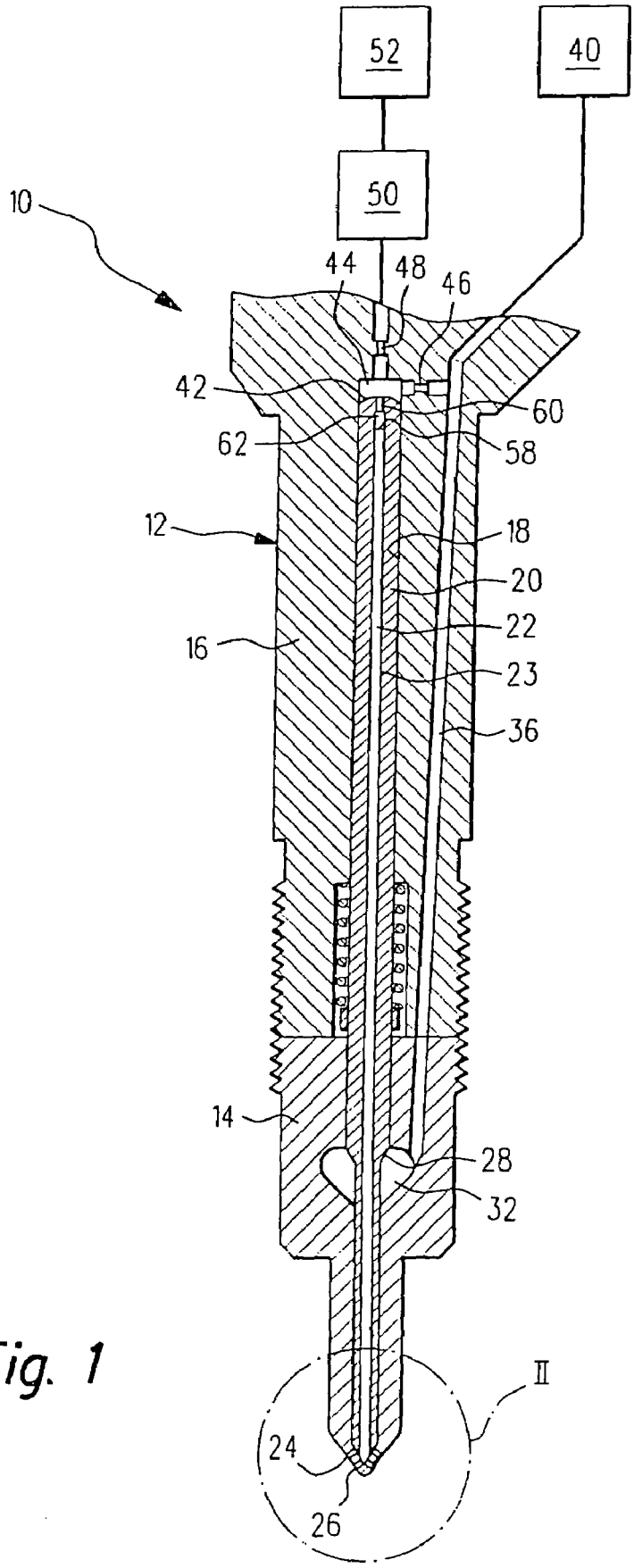
FIG. 1 is a section through a region of a fuel injection device.

In FIG. 1, a fuel injection device is identified overall by reference numeral 10. It includes a housing 12, of which in FIG. 1 only a nozzle body 14 and a central piece 16 are shown. The nozzle body 14 is clamped relative to the central piece 16 via a retaining screw, not shown.

In the housing 12, there is a recess or stepped bore 18, into which an outer valve element 20 and an inner valve element 22 are inserted. Between them, there is a guide gap 23 (see FIG. 2). As will be discussed hereinafter in greater detail, a series of fuel outlet conduits 24 is associated with the outer valve element 20, while a series of fuel outlet conduits 26 is associated with the inner valve element 22.

The outer valve element 20 has a conical end region 27. On it, there are pressure faces 28 and 30 (see FIG. 2), acting in the opening direction, which define pressure chambers 32 and 34, which communicate constantly, via a high-pressure conduit 36 and an annular chamber 38, which is located between the recess 18 and the outer valve element 20, with a high-pressure connection 40. The high-pressure connection 40 of the fuel injection device 10 is connected to a fuel collection line ("rail"), not shown, in which fuel, such as gasoline or diesel, is stored at very high pressure.

On the end of the outer valve element 20 facing away from the fuel outlet conduits 24, this valve element has a control face 42, which acts in the closing direction and defines a control chamber 44. The control chamber communicates constantly with the high-pressure conduit 36 via an inflow throttle restriction 46. An outflow throttle restriction 48 leads from the control chamber 44, via a switching valve 50, to a low-pressure connection 52. The low-pressure connection is connected to a return line, not shown, which for instance returns to a fuel tank.

The inner valve element 22 also has a conical end region, with a pressure face 54 (FIG. 2) that acts in the opening direction and defines a pressure chamber 56, but the pressure chamber communicates with the high-pressure connection 40 via the annular chamber 38 and the high-pressure conduit 36 only when the outer valve element 20 is open. On the end facing away from the fuel outlet conduits 26, the inner valve element 22 also has a control face 58, which acts in the closing direction and defines a control chamber 62, which is located in the outer valve element 20 and communicates with the control chamber 44 via a conduit 60.

Figure 2:
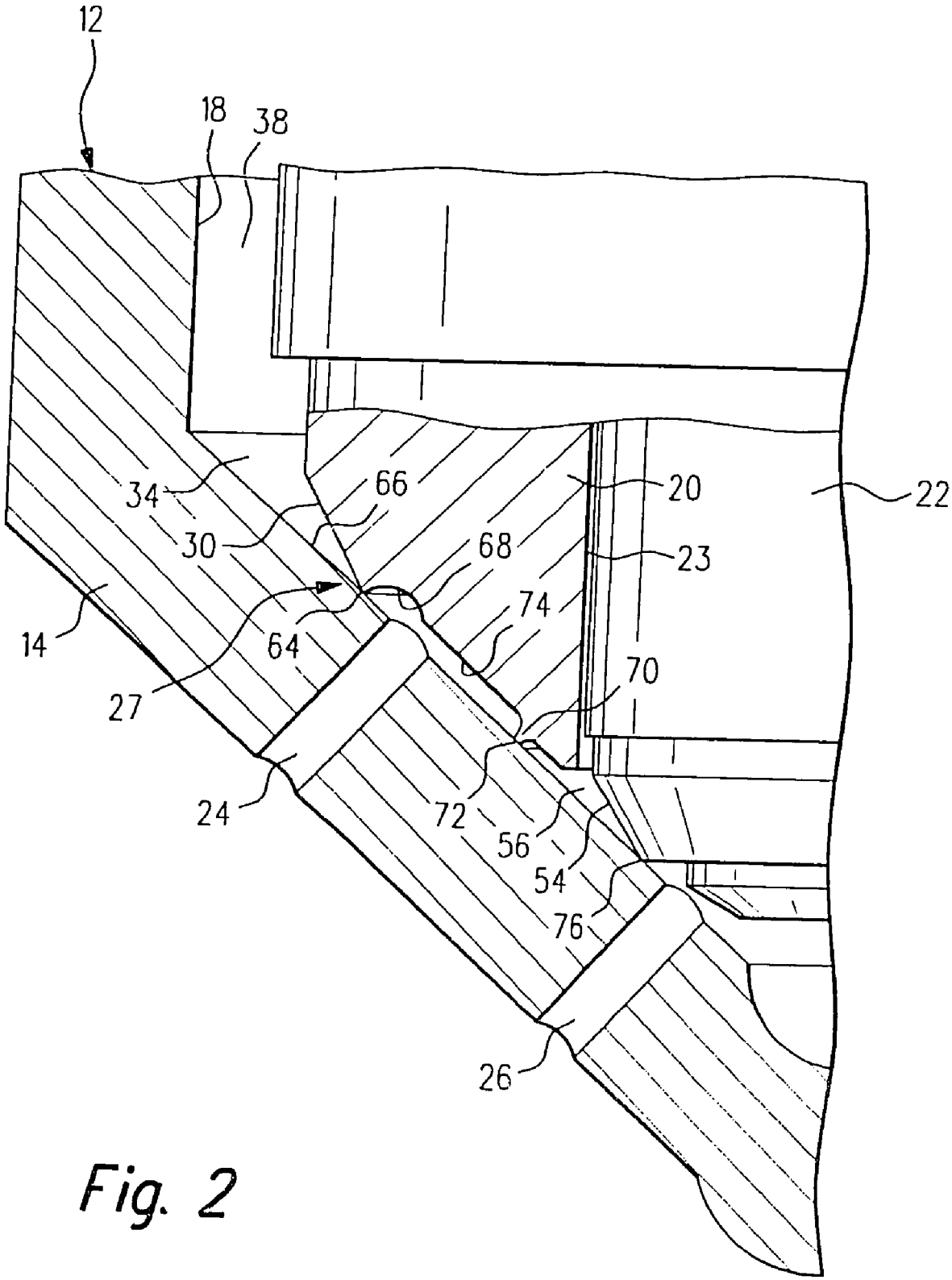
FIG. 2 is a detail II of FIG. 1.

As can be seen from FIG. 2, the outer valve element 20 has a first sealing region, in the form of a first sealing edge 64, which cooperates with a diametrically opposed valve seat face 66 on the housing. The sealing edge 64 is embodied on the radially outer edge of a groove 68 extending around the outer valve element 20. The radially inner edge of this groove is located approximately facing the middle of the fuel outlet conduits 24. Radially obliquely inward from the groove 68, or from the fuel outlet conduits 24, there is an annular protuberance 70 extending all the way around on the conical end region 27 of the outer valve element 20; its projecting edge forms an additional sealing region, in the form of a second sealing edge 72. This sealing edge cooperates with a radially obliquely inward-located region of the valve seat face 66 of the housing. An encompassing shallow groove 74 extends from the groove 68 to the annular protuberance 70.

On the inner valve element 22 as well, there is a sealing edge 76. It defines the pressure face 54 radially obliquely inward and cooperates with a likewise radially obliquely inward-located region of the valve seat face 66. When the inner valve element 22 is closed, the series of fuel outlet conduits 26, which are associated with the inner valve element 22, is located radially obliquely inward from the sealing edge 76.

The fuel injection device 10 shown in FIGS. 1 and 2 is operated as follows:

Via the high-pressure connection 40 and the high-pressure conduit 36 as well as the annular chamber 38, the high fuel pressure which also prevails in the fuel rail is applied constantly to the pressure faces 28 and 30 of the outer valve element 20. It is assumed initially that the switching valve 50 is closed. In that case, this high fuel pressure also prevails in both the control chamber 44 and the control chamber 62. Since the control face 42 of the outer valve element 20 is larger than the total area of the two pressure faces 28 and 30, there is a resultant force acting in the closing direction, by which the sealing edge 64 and the second sealing edge 72 are both pressed against the valve seat face 66. The communication from the annular chamber 38 or the pressure chamber 34 to the series of fuel outlet conduits 24 is thus interrupted. The pressure chamber 56, which is defined by the pressure face 54 of the inner valve element 22, is also separated from the high fuel pressure that prevails in the annular chamber 38.

For injecting a comparatively small quantity of fuel, the switching valve 50 is briefly opened. As a result, fuel can flow out of the control chamber 44 via the outflow throttle restriction 48 to the low-pressure connection 52. Since the fuel flows out faster than it can flow in through the inflow throttle restriction 46, the pressure in the control chamber 44 drops, as does the corresponding force acting on the control face 42 in the closing direction. As a consequence, there is a resultant force acting overall in the opening direction (after all, the high fuel pressure continues to act on the pressure faces 28 and 30), so that the outer valve element 20 opens, and the sealing edges 64 and 72 lift from the opposing valve seat face 66.

As a result, the annular chamber 38 or the pressure chamber 34 is made to communicate with the series of fuel outlet conduits 24, so that fuel exits at high pressure through the fuel outlet conduits 24.

With the outer valve element 20 open, a correspondingly high fuel pressure also prevails in the pressure chamber 56, and this leads to a force acting in the opening direction at the pressure face 54 of the inner valve element 22. However, since the switching valve 50 is opened only briefly, and since the conduit 60 that connects the control chamber 44 of the outer valve element 20 with the control chamber 62 of the inner valve element 22 is embodied as a flow throttle, the lowering of pressure in the control chamber 22 has only a delayed and limited effect on the control chamber 62. In any case, the reduction in pressure in the control chamber 62 is only so slight that the force acting in the closing direction on the control face 58 is greater than the force acting in the opening direction of the pressure face 54. The inner valve element 22 therefore remains closed. Fuel can accordingly not exit through the fuel outlet conduits 26 associated with the inner valve element 22.

If a greater fuel quantity is to be injected, then the switching valve 50 is opened for a comparatively longer time. As a consequence, there is also a pronounced pressure drop in the control chamber 62, which is defined by the control face 58 on the inner valve element 22. This pressure drop is so pronounced that the force acting in the opening direction on the pressure face 54 of the inner valve element 22 now predominates, and the inner valve element 22 opens. Fuel can now exit from the fuel outlet conduits 26 as well. The injection is terminated by closing the switching valve 50.

Above all upon termination of an injection, the additional second sealing edge 72, which is present on the outer valve element 20, has particular significance: That is, it prevents fuel from emerging from the fuel outlet conduits 24 whenever the first sealing edge 64 is already resting on the valve seat face 66. In this respect the following should be noted:

In the control chamber 62, particularly with the valve elements 20 and 22 closed, a comparatively high fuel pressure prevails. It is true that the inner valve element 22 is guided in fluid-tight fashion in the outer valve element 20, but such a fluid-tight guidance cannot completely prevent fuel from passing through. To assure an ease of motion of the inner valve element 22, there must in fact be the guide gap 23 between the inner valve element 22 and the outer valve element 20. Via this guide gap 23, a slight quantity of fuel can flow out of the control chamber 62 into the pressure chamber 56.

If the additional sealing edge 72 were not present, this "leak fuel" could pass unhindered out of the pressure chamber 56 to reach the fuel outlet conduits 24 and could emerge through them into the combustion chamber of the engine. That would worsen the emissions performance of the engine. By means of the additional sealing edge 72, the communication between the pressure chamber 56 and the fuel outlet conduits 24 when the outer valve element 20 is closed is interrupted. Leak fuel passing through the guide gap 23 can accordingly no longer reach the fuel outlet conduits 24.

The additional sealing edge 72 on the outer valve element 20 has still another effect as well: In combustion, hydrocarbon is created in the combustion chamber of the engine. The hydrocarbon can reach the interior of the fuel injection device 10 via the fuel outlet conduits 24 and 26. The second sealing edge 72 reliably prevents hydrocarbon from getting into the guide gap 23 between the inner valve element 22 and the outer valve element 20. Correspondingly increased wear in the region of the guide gap 23 is thus reliably avoided.

The outer valve element 20 of the fuel injection device 10 shown in FIGS. 1 and 2 thus has a "double seat", which can typically be produced only at great effort and expense. This effort and expense is reduced markedly, however, in the fuel injection device shown: The additional sealing edge 72 is in fact produced with a defined minimum size. This means nothing else than that initially, in a new and as yet unused fuel injection device, with the valve element 20 closed, it has a spacing from the opposed valve seat face 66. In the present exemplary embodiment, this spacing amounts to approximately 1 to 2 μm.

When the fuel injection device is put into operation, a certain initial wear or initial deformation necessarily occurs at the first sealing edge 64 and the opposed valve seat face 66. As a result, the gap that initially exists between the additional sealing edge 72 and the opposed valve seat face 66, when the outer valve element 20 is closed, decreases in size, until the additional sealing edge 72, when the valve element 20 is closed, also rests on the opposed valve seat face 66 and thus assures secure sealing.

Figure 3:
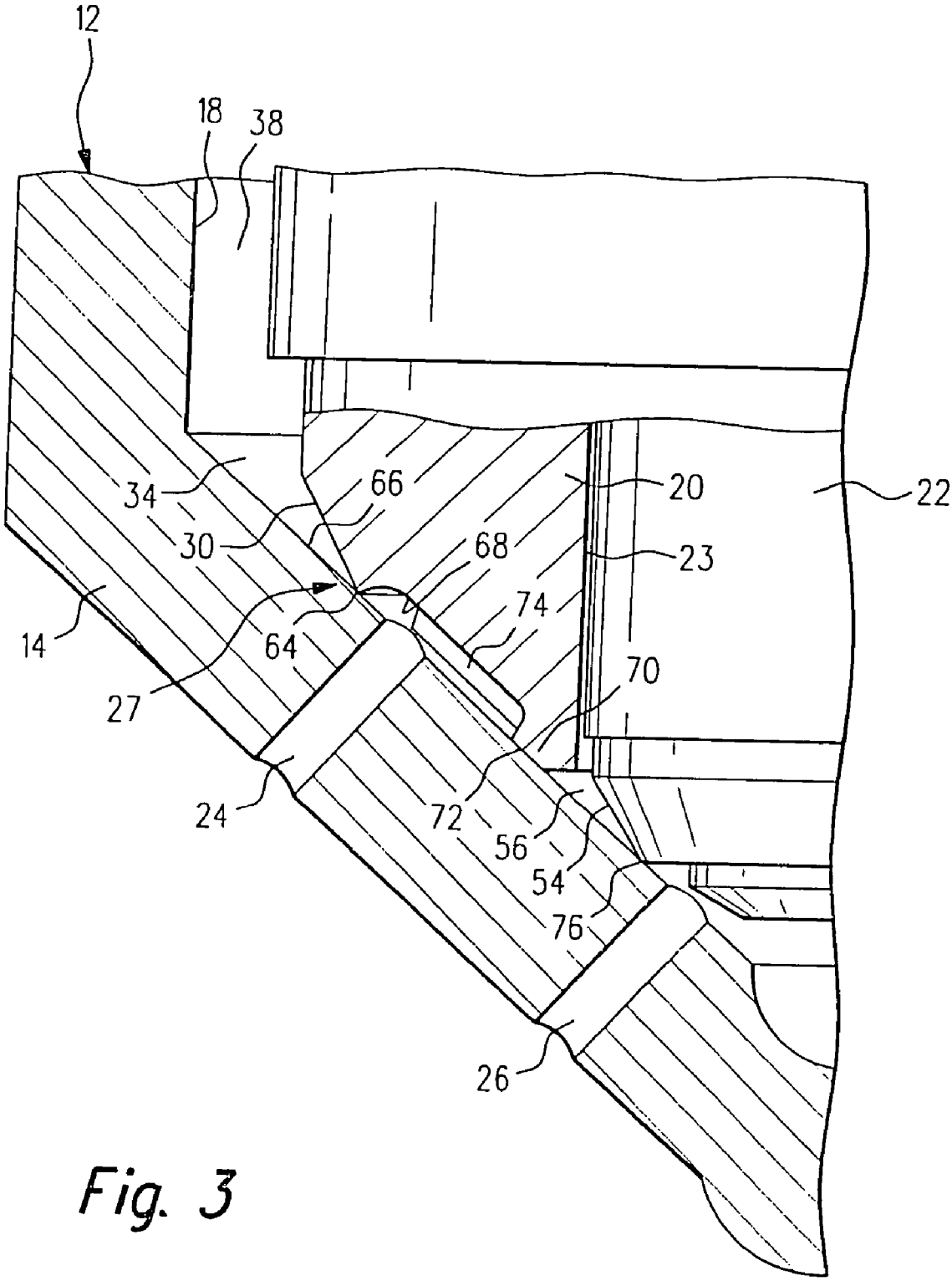
FIG. 3 is a view similar to FIG. 2 of an alternative embodiment.
Figure 4:
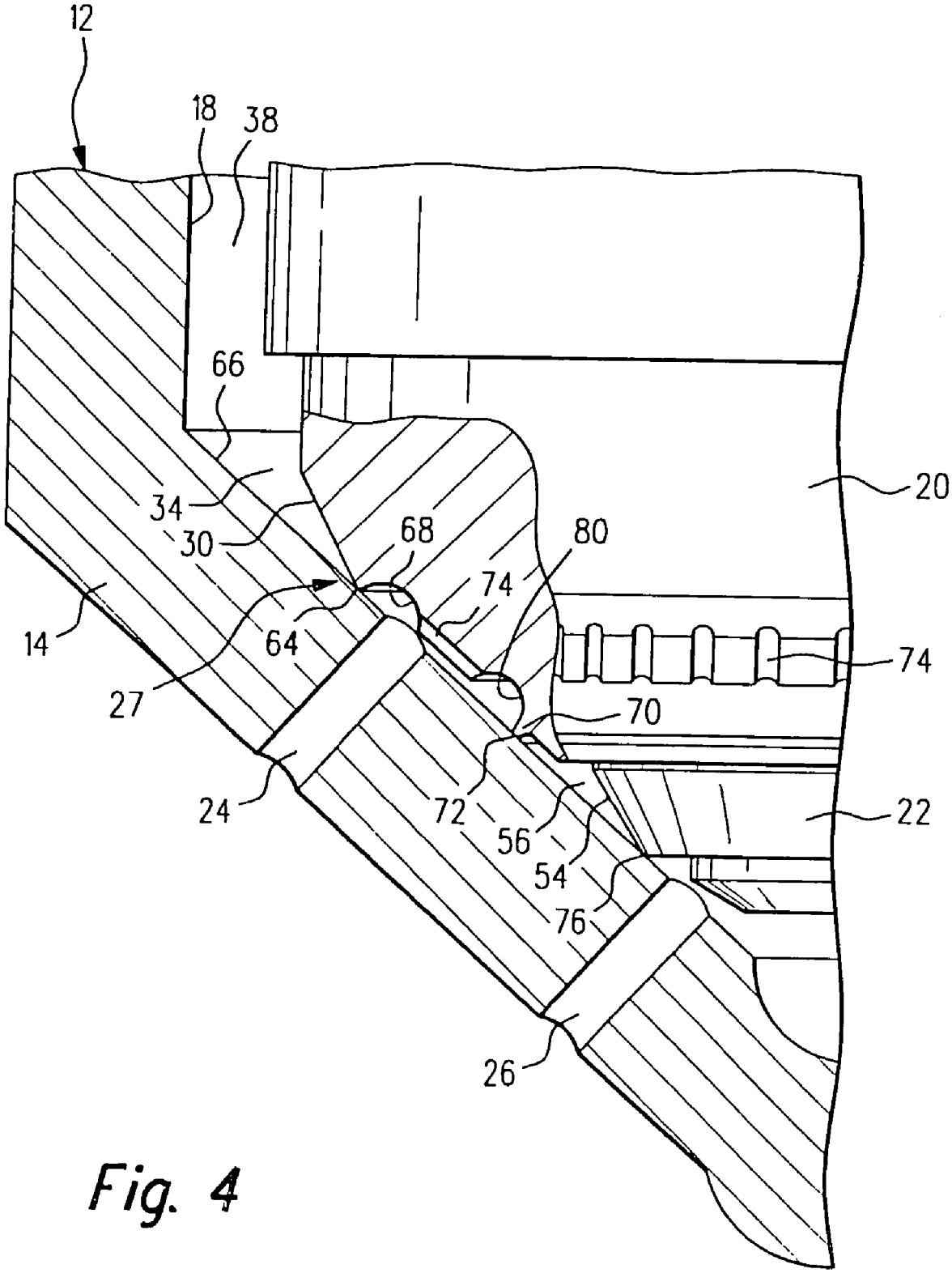
FIG. 4 is a view similar to FIG. 2 of a further-modified embodiment.

Alternative embodiments of fuel injection devices 10 are shown in FIGS. 3 and 4. Elements and regions that have equivalent functions to elements and regions of the fuel injection device shown in FIGS. 1 and 2 have the same reference numerals. They are not explained again in detail. The distinctions essentially pertain to the design of the conical end region 27 of the outer valve element 20 between the groove 68 and the annular protuberance 70.

In the fuel injection device 10 shown in FIG. 3, instead of a single encompassing shallow groove, there is a plurality of grooves 74, distributed over the circumference and all extending in the axial direction. Moreover, in the fuel injection device 10 shown in FIG. 3, the annular protuberance 70 has a greater width. In FIG. 4, in turn, in addition to the grooves 74, there is an encompassing groove 80, which is radially obliquely outward from the annular protuberance 70 and whose cross section, like that of the groove 68, is approximately semicircular.

The foregoing relates to a preferred exemplary embodiment of the invention, it being understood that other variants and embodiments thereof are possible within the spirit and scope of the invention, the latter being defined by the appended claims.

The invention claim is:

1. In a fuel injection device, for an internal combustion engine with direct fuel injection, having a housing and at least two valve elements comprising:

an inner valve element and an outer valve element inserted coaxially to one another into the housing;

at least one first fuel outlet opening disposed in the housing and associated with the outer valve element;

at least one second fuel outer opening disposed in the housing and associated with the inner valve element;

a valve seat disposed in the housing which valve seat is engaged and disengaged with the inner valve element and the outer valve element to open and close the associated fuel outlet openings from a high-pressure fuel connection;

a first sealing region cooperating with the valve seat and disposed on the outer valve element in a location radially outward from the at least one first fuel outlet opening; and a second sealing region cooperating with the valve seat and disposed on the outer valve element between the at least one first fuel outlet opening and the inner valve element;

wherein a gap initially exists following initially assembly of the device, between the second sealing region and the valve seat there-opposing the outer valve element in a closed position, wherein the gap is preferably approximately 1 to 2 μm.

2. In a fuel injection device, for an internal combustion engine with direct fuel injection, having a housing and at least two valve elements comprising:

an inner valve element and an outer valve element inserted coaxially to one another into the housing;

at least one first fuel outlet opening disposed in the housing and associated with the outer valve element;

at least one second fuel outer opening disposed in the housing and associated with the inner valve element;

a valve seat disposed in the housing which valve seat is engaged and disengaged with the inner valve element and the outer valve element to open and close the associated fuel outlet openings from a high-pressure fuel connection;

a first sealing region cooperating with the valve seat and disposed on the outer valve element in a location radially outward from the at least one first fuel outlet opening; and a second sealing region cooperating with the valve seat and disposed on the outer valve element between the at least one first fuel outlet opening and the inner valve element;

wherein the first sealing region is embodied by a sealing edge of a first annular groove extending around the outer valve element, and wherein the first groove has an approximately semicircular cross-section and wherein at least a portion of the semicircular cross-section of the groove is located generally opposing the at least one first fuel opening.

3. The fuel injection device in accordance with claim 1, wherein the first sealing region is embodied on the edge of a first annular groove extending around the outer valve element and further comprising a second elongated groove extending approximately from the first groove to the second sealing region on the outer valve element.

4. The fuel injection device in accordance with claim 2, further comprising a second elongated groove extending approximately from the first groove to the second sealing region on the outer valve element.

5. The fuel injection device in accordance with claim 1, wherein the first sealing region is embodied on the edge of a first annular groove extending around the outer valve element and further comprising a plurality of second elongated grooves distributed over the circumference and all extending in the axial direction approximately from the first groove to the second sealing region.

6. The fuel injection device in accordance with claim 2, further comprising a plurality of second elongated grooves distributed over the circumference and all extending in the axial direction approximately from the first groove to the second sealing region.

7. The fuel injection device in accordance with claim 1, wherein the second sealing region is embodied by a sealing edge of a third radially narrow, deep groove, which third groove is located in the direction toward the first sealing region.

8. The fuel injection device in accordance with claim 2, wherein the second sealing region is embodied by a sealing edge of a third radially narrow, deep groove, which third groove is located in the direction toward the first sealing region.

9. The fuel injection device in accordance with claim 3, wherein the second sealing region is embodied by a sealing edge of a third radially narrow, deep groove, which third groove is located in the direction toward the first sealing region.

10. The fuel injection device in accordance with claim 5, wherein the second sealing region is embodied by a sealing edge of a third radially narrow, deep groove, which third groove is located in the direction toward the first sealing region.

11. The fuel injection device in accordance with claim 1, wherein the second sealing region is embodied on an annular protuberance projecting from the outer valve element.

12. The fuel injection device in accordance with claim 2, wherein the second sealing region is embodied on an annular protuberance projecting from the outer valve element.

13. The fuel injection device in accordance with claim 1, further comprising a guide gap between the two valve elements, and wherein the guide gap is connected to the high-pressure connection via a hydraulic control chamber.

14. The fuel injection device in accordance with claim 2, further comprising a guide gap between the two valve elements, and wherein the guide gap is connected to the high-pressure connection via a hydraulic control chamber.

15. The fuel injection device in accordance with claim 7, further comprising a guide gap between the two valve elements, and wherein the guide gap is connected to the high-pressure connection via a hydraulic control chamber.

16. A method for producing a fuel injection device in accordance with claim 1, comprising the steps of:

fabricating the outer valve element such that an initial gap is provided between the second sealing region and its associated valve seat, with the outer valve element in a closed position, wherein the initial gap is preferably of approximately 1 to 2 μm ;and repeatedly actuating the outer valve element and thereby deforming; the first sealing region and/or the valve seat associated with it such that the initial gap between it and the valve seat associated with it becomes less or tends toward zero.

* * * * *

UNITED STATES PATENT AND TRADEMARK OFFICE

CERTIFICATE OF CORRECTION

PATENT NO. : 7,309,029 B2
APPLICATION NO. : 10/579849
DATED : December 18, 2007
INVENTOR(S) : Friedrich Boecking It is certified that error appears in the above-identified patent and that said Letters Patent is hereby corrected as shown below:

On Title page, item 54 and column 1, lines 1-4 should read as follows:

(54) FUEL INJECTION DEVICE FOR AN INTERNAL COMBUSTION ENGINE WITH DIRECT FUEL INJECTION, AND METHOD FOR PRODUCING THE DEVICE

Signed and Sealed this

Fifteenth Day of April, 2008

JON W. DUDAS
*Director of the United States Patent and Trademark Office*